US007708632B2

(12) United States Patent
Lind et al.

(10) Patent No.: US 7,708,632 B2
(45) **Date of Patent: *May 4, 2010**

(54) PHYSICAL BINGO CARD INPUT METHOD IN A BINGO GAMING SYSTEM

(75) Inventors: Clifton Lind, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 1204 days.

This patent is subject to a terminal disclaimer.

(21) Appl. No.: 10/862,089

(22) Filed: Jun. 4, 2004

(65) Prior Publication Data

US 2005/0272499 A1 Dec. 8, 2005

Related U.S. Application Data

(63) Continuation-in-part of application No. 10/834,733, filed on Apr. 29, 2004, now abandoned.

(51) Int. Cl.
*A63F 13/00* (2006.01)

(52) U.S. Cl. ..... 463/19; 463/47

(58) Field of Classification Search ..... 463/1, 463/19, 25, 29, 40–43, 47
See application file for complete search history.

(56) References Cited

U.S. PATENT DOCUMENTS

| | | | | |
|---|---|---|---|---|
| 4,669,729 | A | 6/1987 | Solitt et al. | |
| 5,613,680 | A | 3/1997 | Groves et al. | |
| 5,687,971 | A | 11/1997 | Khaladkar | |
| 6,099,407 | A | 8/2000 | Parker, Jr. et al. | |
| 6,257,980 | B1 | 7/2001 | Santini, Jr. | |
| 6,482,088 | B2 | 11/2002 | Santini, Jr. | |
| 6,569,017 | B2 | 5/2003 | Enzminger et al. | |
| 6,599,188 | B2 | 7/2003 | Hirsch et al. | |
| 6,607,440 | B2 | 8/2003 | Santini, Jr. | |
| 2001/0046892 | A1 | 11/2001 | Santini, Jr. | |
| 2002/0094860 | A1 | 7/2002 | Itkis et al. | |
| 2002/0132661 | A1 | 9/2002 | Lind et al. | |
| 2002/0132666 | A1 | 9/2002 | Lind et al. | |
| 2003/0045342 | A1* | 3/2003 | Miller et al. | 463/19 |
| 2003/0137143 | A1* | 7/2003 | Itkis et al. | 283/49 |
| 2004/0048647 | A1 | 3/2004 | Lind et al. | |
| 2004/0152499 | A1 | 8/2004 | Lind et al. | |

(Continued)

*Primary Examiner*—James S McClellan
(74) *Attorney, Agent, or Firm*—Russell D. Culbertson; JP Cody

(57) ABSTRACT

A method includes issuing a physical bingo card. This physical bingo card is associated with a layout of spots or locations and bingo designations representing a bingo card or "card bingo structure." The method also includes identifying the card bingo structure through a player station and collecting a game play request entered from the player station with at least one additional game play request to form a game group. The game play request is associated with the card bingo structure and each additional game play request in the game group is associated with a respective additional bingo structure. Once the game group is formed, a bingo game may be conducted between the card bingo structure and each additional bingo structure to identify a bingo game result for the card bingo structure and preferably each additional bingo structure. The bingo game result for the card bingo structure is then displayed at the player station.

27 Claims, 9 Drawing Sheets

U.S. PATENT DOCUMENTS

2005/0096120 A1 5/2005 Lind et al.
2005/0119042 A1* 6/2005 Chamberlain et al. ..... 463/19
2005/0255906 A1* 11/2005 Lind et al. ..... 463/19

* cited by examiner

PHYSICAL BINGO CARD INPUT METHOD IN A BINGO GAMING SYSTEM

This application is a continuation-in-part of U.S. patent application Ser. No. 10/834,733, filed May 12, 2004 now abandonded, and entitled "Networked Bingo Gaming System and Gaming Method Using Physical Bingo Card." The Applicants hereby claim the benefit of this earlier application under 35 U.S.C. §120. The entire content of this earlier application is incorporated herein by this reference.

TECHNICAL FIELD OF THE INVENTION

This invention relates to bingo gaming systems. More particularly, the invention relates to a bingo gaming system in which a player participates in bingo games using a physical bingo card in connection with an electronic player station. The invention encompasses bingo gaming systems as well as methods and program products for inputting physical bingo cards in order to conduct bingo games.

BACKGROUND OF THE INVENTION

The game referred to generally as "Bingo" is played with predetermined bingo cards that include a number of designations randomly arranged in a grid or other layout of spots or locations. The bingo cards may be physically printed on paper or another suitable material, or may be represented by a data structure which defines the various card locations and designations associated with the locations. In the traditional bingo game sequence, a number of the predetermined bingo cards are put in play for a particular game. After the sale of bingo cards is closed for a given game, designations are randomly selected from a pool of available designations and matched to the designations on each bingo card that has been placed in play. This matching of randomly selected bingo designations with bingo designations associated with a card in play in the game is commonly referred to as daubing the card and results in a pattern or arrangement of matched spots or card locations. Daubing was done manually by the player holding the bingo card in traditional bingo games. More recent bingo gaming systems automatically check for winning patterns on a bingo card as designations are randomly selected for a game. Regardless of how the bingo cards in play in a game are daubed, the first card daubed in some predefined way is considered a winning card for the game. The predefined way in which a card must be matched or daubed to produce a win in the game is commonly defined in terms of some identifiable pattern of matched or daubed locations on the card.

Although traditional bingo games remain popular, traditional paper bingo games are played relatively slowly. The card purchasing or buy-in period, the sequential ball draw and announcement of each individual designation, and then winner verification all consume a good deal of time. The time required to play a traditional bingo game limits the player excitement with the game and thus limits player satisfaction.

Various systems have been developed to aid players in playing bingo games and to enhance player participation in the games. The MegaMania® gaming system offered by Multimedia Games, Inc. comprises a bingo gaming system in which players at different gaming facilities over a large geographic area may participate in bingo games. The players participate in bingo games in the MegaMania® system through electronic player stations that are maintained at various gaming facilities across the United States. Electronic bingo gaming systems and electronic player stations may increase the speed at which certain operations in a bingo game may be performed. However, electronically implemented bingo games have eliminated the use of physical bingo cards in the interest of increasing the speed of play. The elimination of the physical bingo card may represent an unwelcome change to some players who are used to participating in bingo games with a physical bingo card. The elimination of the physical bingo card may also prevent these newer electronic systems from being employed under certain regulatory schemes relating to bingo gaming systems.

SUMMARY OF THE INVENTION

The present invention provides a gaming system in which a player may use a physical bingo card to participate in bingo games played through an electronic player station. The invention encompasses methods for conducting bingo games, gaming apparatus, and program products.

A method embodying the principles of the invention includes issuing a physical bingo card. This physical bingo card is associated with a layout of spots or locations and bingo designations representing a bingo card. Any layout of locations and the designations contained in those locations to represent a bingo card will be referred to in this disclosure and the accompanying claims as a "bingo structure" in order to avoid confusion with the physical bingo card with which such structures may be associated. A bingo structure associated with a physical bingo card according to the present invention will be referred to herein as a "card bingo structure" to distinguish such bingo structures from those that are not associated with any physical bingo card.

In addition to issuing the physical bingo card associated with a card bingo structure, a method according to the present invention includes identifying the physical bingo card and/or the card bingo structure itself through a player station, and collecting a game play request entered from the player station with at least one additional game play request to form a game group. The game play request is associated with the identified card bingo structure and each additional game play request in the game group is associated with a respective additional bingo structure. Once the game group is formed, a bingo game may be conducted between the card bingo structure and each additional bingo structure to identify a bingo game result for the card bingo structure and preferably each additional bingo structure. The method according to the present invention then includes using the player station to display the bingo game result for the card bingo structure.

An apparatus embodying the principles of the invention includes a physical bingo card issuing station for issuing the physical bingo card associated with the card bingo structure. A player station is included in the system together with a game server in communication with the player station. The player station includes a scanner adapted to scan a physical bingo card to identify the card bingo structure associated with the physical bingo card. The player station responds to a player input at the player station to produce a game play request that is associated with the card bingo structure, communicates the game play request to the game server, receives the bingo game result for the card bingo structure, and communicates the bingo game result to a player at the player station. The game server collects the game play request produced by the player station with at least one additional game play request to form a game group and conducts a bingo game between the card bingo structure and each additional bingo structure to identify the bingo game result for the card bingo structure. This bingo game result for the card bingo structure is then communicated back to the player station for display to the player.

A program product embodying the principles of the invention includes scanner program code, player station program code, and game server program code. The scanner program code controls the operation of the player station scanner to identify the card bingo structure associated with the physical bingo card. The player station program code produces the game play request in response to the player input at the player station and controls the communication of the bingo game result to the player at the player station. The game server program code controls the collection of the game play request with the additional game play requests to form the game group and conducts the bingo game between the card bingo structure and each additional bingo structure to identify the bingo game result for the card bingo structure.

These and other advantages and features of the invention will be apparent from the following description of the preferred embodiments, considered along with the accompanying drawings.

DESCRIPTION OF PREFERRED EMBODIMENTS

The present invention will be described below in reference to a particular bingo gaming system in which game play requests or bingo structures are grouped together rapidly for conducting bingo games. This bingo gaming system is described in further detail in pending U.S. patent application Ser. No. 10/456,721, filed Jun. 6, 2003 and entitled "Method, System, and Program Product for Conducting Multiple Concurrent Bingo-Type Games." The entire content of this application is hereby incorporated by this reference. It will be appreciated, however, that although this illustrated bingo gaming system provides a convenient example of a gaming system in which the present invention may be employed, the invention is by no means limited to use with this type of bingo gaming system. Rather, the present invention of using physical bingo cards in a networked bingo gaming system may be employed in substantially any networked bingo gaming system. In particular, the present invention may be used in a session bingo system in which bingo games are played sequentially throughout various bingo sessions.

Figure 1:
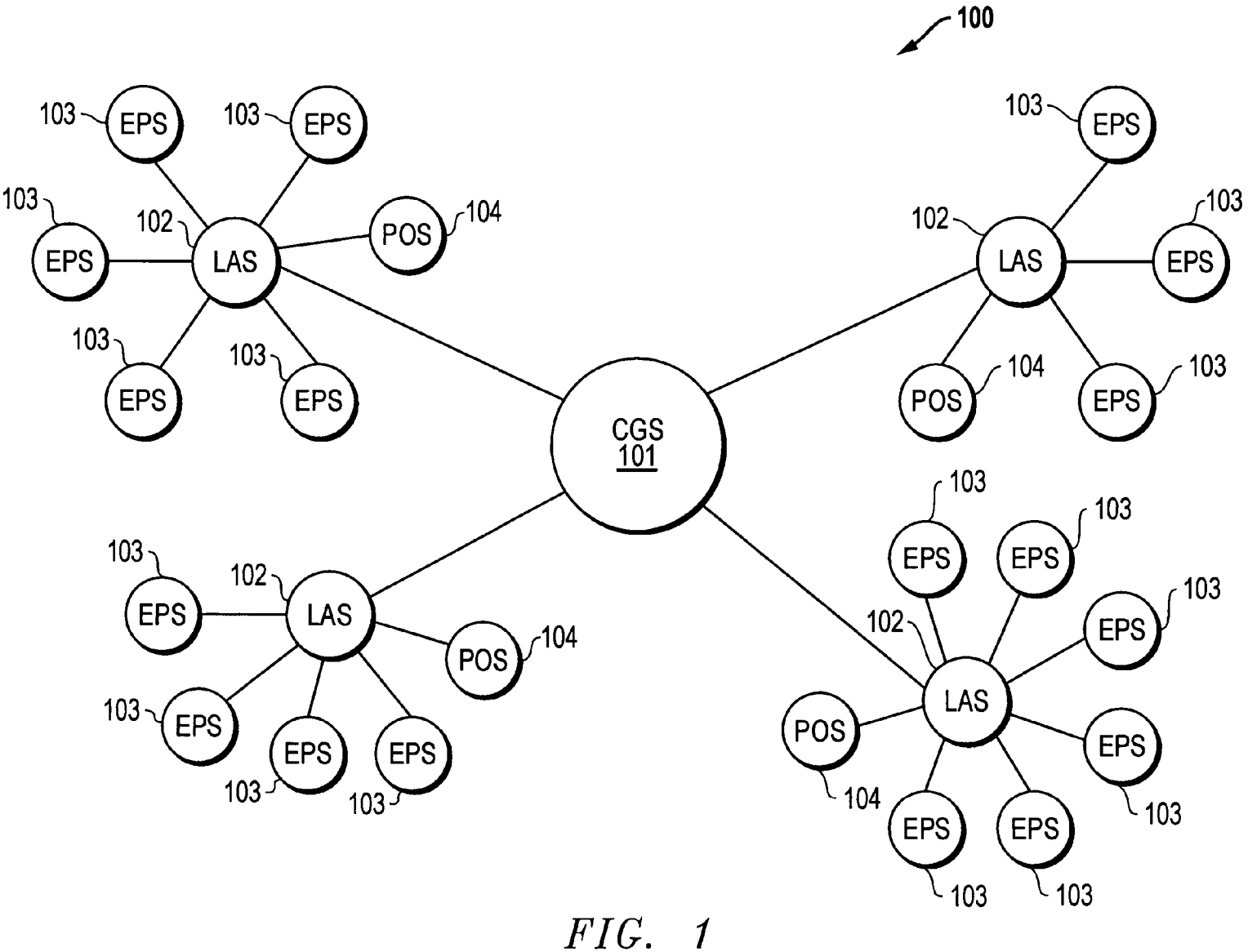
FIG. 1 is a high level diagrammatic representation of a bingo gaming system embodying the principles of the present invention.

FIG. 1 shows a gaming system 100 including a central game server or game server (CGS) 101 that cooperates with a number of other components to enable bingo players, preferably at many different remote gaming sites, to participate in bingo games. Each gaming site includes a local area server (LAS) 102, preferably a number of electronic player stations (EPSs) 103, and preferably a point-of-sale station (POS) 104. As will be discussed in detail below, in one preferred operation of gaming system 100, a player at any EPS 103 in the system may participate in a given bingo game with players at any other EPSs 103 in the system. Thus, players at different gaming facilities may be grouped together for a given bingo game administered through system 100.

The invention includes an arrangement for grouping players and/or game play requests for the play of a single bingo game to facilitate rapid play. This grouping may include limiting the number of players and/or game play requests included in a bingo game to reduce the time required to play the game. The time between a game play request at one of the EPSs 103 and the return of results to the respective EPS may be reduced sufficiently to allow a great deal of flexibility in how results in the bingo game are displayed to the player. In particular, the bingo game results may be displayed in some manner unrelated to bingo. For example, the bingo game results may be mapped to a display traditionally associated with a reel-type game (slot machine), to a display relating to a card game, or to a display showing a race such as a horse or dog race, for example. Preferred techniques for mapping bingo game results to displays associated with games or contests unrelated to bingo are described in U.S. patent application publication No. 2002-0132661 A1, entitled "Method, Apparatus, and Program Product for Presenting Results in a Bingo-Type Game." The entire content of this publication is incorporated herein by this reference.

As will be described further below and in the above-mentioned U.S. application Ser. No. 10/456,721, system 100 may rapidly group players and/or game play requests and starts one game after another so that multiple games may be in play at any given time. That is, once a first group of players or game play requests has been assigned to a bingo game offered through system 100, the system proceeds to simultaneously administer a bingo game for the first group of players or game play requests and also begins grouping players or game play requests for a next bingo game. In this type of play, system 100 may not necessarily wait for one bingo game to be completed before starting to collect players or game play requests for, and actually beginning play in, the next bingo game. The number of players or game play requests grouped for the play of bingo games according to this mode of play may be limited to reduce the time required for grouping. For example, each bingo game offered through gaming system 100 shown in FIG. 1 may be limited to between 2 to 20 players or game play requests, with the preferred number for any given game being from 10 to 15. The minimum number of game play requests required to form a game group in this mode of play will be referred to herein as a "quorum" of game play requests. Where system 100 includes numerous EPSs 103 at the various remote locations, on the order of several thousand EPSs for example, hundreds of individual bingo games may be in process at any given time through the gaming system.

Alternatively, to this multiple simultaneous game mode of play, system 100 may be adapted to conduct bingo games sequentially in bingo sessions. Although this session bingo mode of play may not conduct bingo games based upon any number of game play requests that have been collected, bingo games may still be conducted relatively rapidly to minimize the delay between the time that a player places a card bingo structure in play according to the invention and the time that the player's EPS 103 receives and displays the result of the game play.

Regardless of the rapid play facilitated by system 100 and regardless of the manner in which the bingo game results are displayed, the underlying game remains a standard bingo game played in the traditional sequence of play for bingo games. That is, each player obtains or is assigned a bingo structure (either a card bingo structure or a bingo structure not associated with a physical bingo card), all bingo structures in play in the game are daubed or checked for matches with a randomly generated sequence of designations (for example, designations produced in a ball draw or produced by a random number generator), and the first bingo structure in the game to match the sequence of designations to produce the game ending winning pattern wins the bingo game. Additional prizes may be awarded for other patterns that may be produced in the course of the bingo game. The mapping of different prizes to various bingo patterns that may be produced in the course of a bingo game in system 100 may be accomplished as described in U.S. Pat. No. 6,569,017 B2, entitled "Method for Assigning Prizes in Bingo-Type Games" or U.S. patent application publication No. 2004-0048647-A1, entitled "Prize Assignment Method and Program Product for Bingo-Type Games." The entire content of each of these documents is incorporated herein by this reference.

According to the present invention, even though gaming system 100 comprises a high-speed bingo gaming system in which players may participate in bingo games through EPSs 103, a player may still participate in bingo games offered through the system using a physical bingo card. System 100 may be configured so that all players must be issued a physical bingo card and use that card to participate in bingo games offered through the system. Alternatively, system 100 may be configured so that player's playing with physical bingo cards and players without physical bingo cards may participate in the same bingo games. Yet another implementation of system 100 may group players using physical bingo cards together for producing a game group for a bingo game, and may group players not using physical bingo cards into separate game groups. Example processes associated with grouping players or game play requests and conducting bingo games for those game groups according to the invention will be described below with particular reference to FIGS. 8, 9, and 10.

Figure 2:
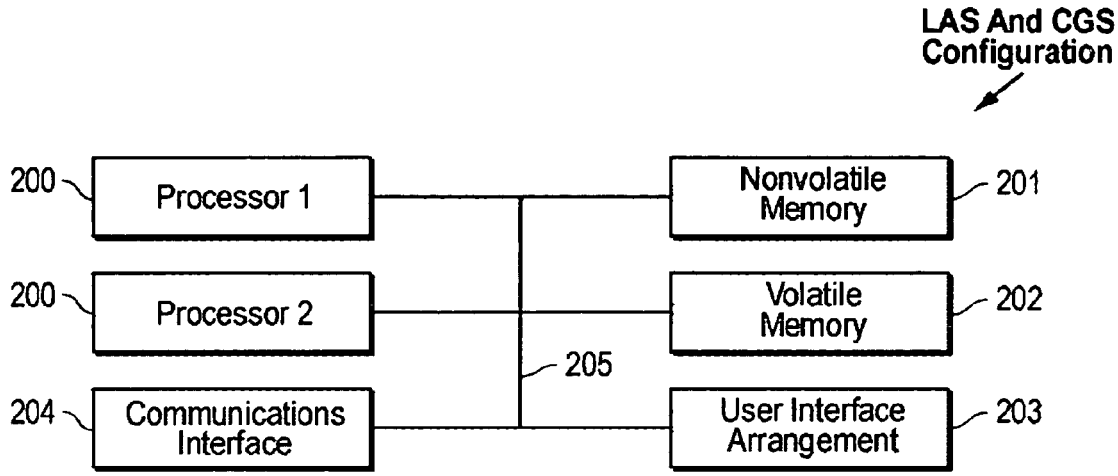
FIG. 2 is a diagrammatic representation of a computer system arrangement that may be used for the central game server and local area servers included in the system shown in FIG. 1.

CGS 101 may comprise a computer system such as the basic system shown in FIG. 2. The basic system may include one or more processors 200, nonvolatile memory 201, volatile memory 202, a user interface arrangement 203, and a communications interface 204, all connected to a system bus 205. It will be appreciated that user interface arrangement 203 may include a number of different devices such as a keyboard, a display, and a pointing device such as a mouse or trackball for example, although not shown in FIG. 2. Alternatively to the integrated user interface arrangement 203 shown in FIG. 2, a user interface for CGS 101 may be provided through a separate computer (not shown) in communication with the CGS. Regardless of the particular configuration for CGS 101, in one preferred operation of system 100 shown in FIG. 1, the CGS functions to group players for participation in bingo games offered through the system, produces or obtains sequences of designations (ball draws, for example) for the play of the bingo games, checks for the results in the bingo games, and communicates the results to LASs 102. Specific processes performed by CGS 101 to provide these functions will be described below with reference to FIG. 9.

As used in this disclosure, any sequence of designations that may be matched against bingo cards or card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device.

Each LAS 102 included in system 100 as shown in FIG. 1 may comprise a computer system having the same basic structure as shown in FIG. 2. That is, each LAS 102 may include one or more processors 200, nonvolatile memory 201, volatile memory 202, user interface arrangement 203, and communications interface 204 all connected to system bus 205. As with CGS 101, the user interface for the respective LAS 102 may be provided through a separate computer and communications with the LAS rather than the integrated user interface arrangement 203 shown in FIG. 2. Regardless of the specific configuration of the LAS, each LAS serves, in the preferred operation of the system shown in FIG. 1, to transfer or relay information from its respective EPSs 103 to CGS 101 and transfer or relay information from the CGS to the LAS's respective EPSs. Each LAS according to the present invention may also have the ability to group players and actually play bingo games in certain situations. For example, where one LAS 102 serves a large number of EPSs 103, the LAS may group players or game play requests from its respective EPSs during a time of high player activity, obtain or produce a ball draw, determine results, and return results to the EPSs rather than having the CGS 101 perform these tasks. Also, each LAS 102 shown in FIG. 1 may be configured to perform the tasks normally performed by CGS 101 in the event the communications link between the respective LAS and CGS is degraded below a certain level or is severed altogether. Specific processes that may be performed by LASs 102 according to the invention will be described below with reference to FIG. 8.

Figure 3:
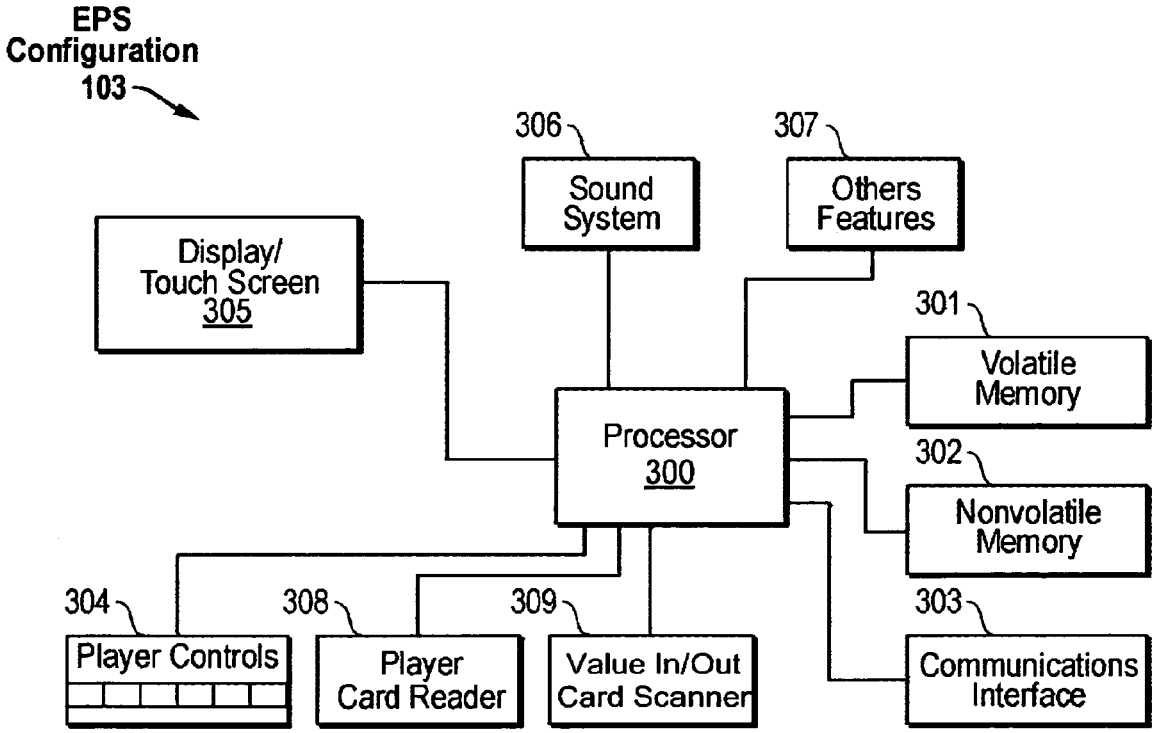
FIG. 3 is a diagrammatic representation of an electronic player station that may be used in the system shown in FIG. 1.

FIG. 3 shows an example of an EPS 103 that may be used in a gaming system embodying the principles of the present invention. The illustrated EPS 103 includes a processor 300, volatile memory 301, nonvolatile memory 302, and a communications interface 303. The volatile and nonvolatile memory stores computer program code that may be executed by processor 300 to cause the processor to perform or direct the various functions provided by EPS 103. Communications interface 303 allows communications between EPS 103 and its respective LAS 102 and/or CGS 101. EPS 103 also includes a user interface arrangement to facilitate player participation in the bingo games offered through gaming system 100 shown in FIG. 1, and display results in an exciting and attractive format. This interface includes player controls 304, a display or touch screen display 305, a sound system 306, and perhaps other features 307 such as alarms or special displays or alerting devices.

The player interface at EPS 103 also includes an arrangement by which information regarding a physical bingo card may be entered into the gaming system. One arrangement may comprise a keypad included in player controls 304 through which a player may manually enter their physical bingo card information at EPS 103. A keypad for manual bingo card information entry may also be implemented through touch screen 305. Alternatively or in addition to a manual card information entry device such as a keypad, EPS 103 may include a suitable card reader 308. Card reader 308 may, for example, comprise a reader for reading information encoded on a magnetic medium (mag stripe) associated with a physical bingo card. Card reader 308 may also be used for reading player-specific information from a player account card or physical bingo card inserted into the reader. Such a card may, for example, include player information or simply a player identifier encoded on the magnetic medium associated with the card. Of course, card reader 308 is not limited to a mag stripe reader or any other type of reader. Rather, card reader 308 may be adapted to read bar codes, a memory device associated with the player card, or data transmitted from a transceiver associated with the card. Card reader 308 may also serve as a scanner according to the present invention. In this alternative, card reader 308 may include or comprise a suitable scanning device such as an optical scanner that scans an object placed in the device and produces a scan output. Card reader 308 may also include a suitable scan controller for applying pattern recognition to the scan output to identify one or more card bingo structures associated with a physical bingo card described below with reference to FIGS. 6A and 6B. The illustrated EPS 103 also includes a separate device 309 for receiving value and issuing value in the course of play. This device may accept currency, vouchers, or tokens, for example, and also output currency, vouchers, or tokens, and may comprise or include a suitable scanner such as an optical scanner together with its own scan controller. In one preferred form of the invention, device 309 may operate both to receive and issue value and may identify the player's card bingo structure(s) according to the present invention. That is, device 309 may be adapted to identify and accept currency, either government issued currency or gaming facility issued currency or script, and also identify card bingo structures from a player's physical bingo card. Alternatively, or in addition to value in/out device 309, EPSs 103 may read player account information from a player card or player information otherwise input at the EPS, and account for wagers and winnings in the manner set out in U.S. patent application publication No. 2002-0132666 A1, entitled "Distributed Account Based Gaming System," the entire content of which is incorporated herein by this reference. It will be noted that a physical bingo card according to the present invention may also serve as a player card carrying a player identifier or player account identifier which may be read or entered at EPS 103 and used in the accounting process described in the patent application publication described in the previous sentence. Where an account based arrangement is included in a gaming system embodying the principles of the invention, the accounting functions are preferably performed through an account server implemented through a processor at the respective LAS 102 for the particular gaming facility under the control of account server program code.

FIG. 3 shows two separate devices 308 and 309 for reading player card information, reading physical bingo card information, and receiving value. It will be appreciated that a single device may be used to perform all of these functions within the scope of the present invention. In particular, a single device may read or scan information from a physical bingo card, and either use that information to obtain card bingo structure information, player information, or player account information, or scan or read multiple cards or media to obtain that information.

Figure 4:
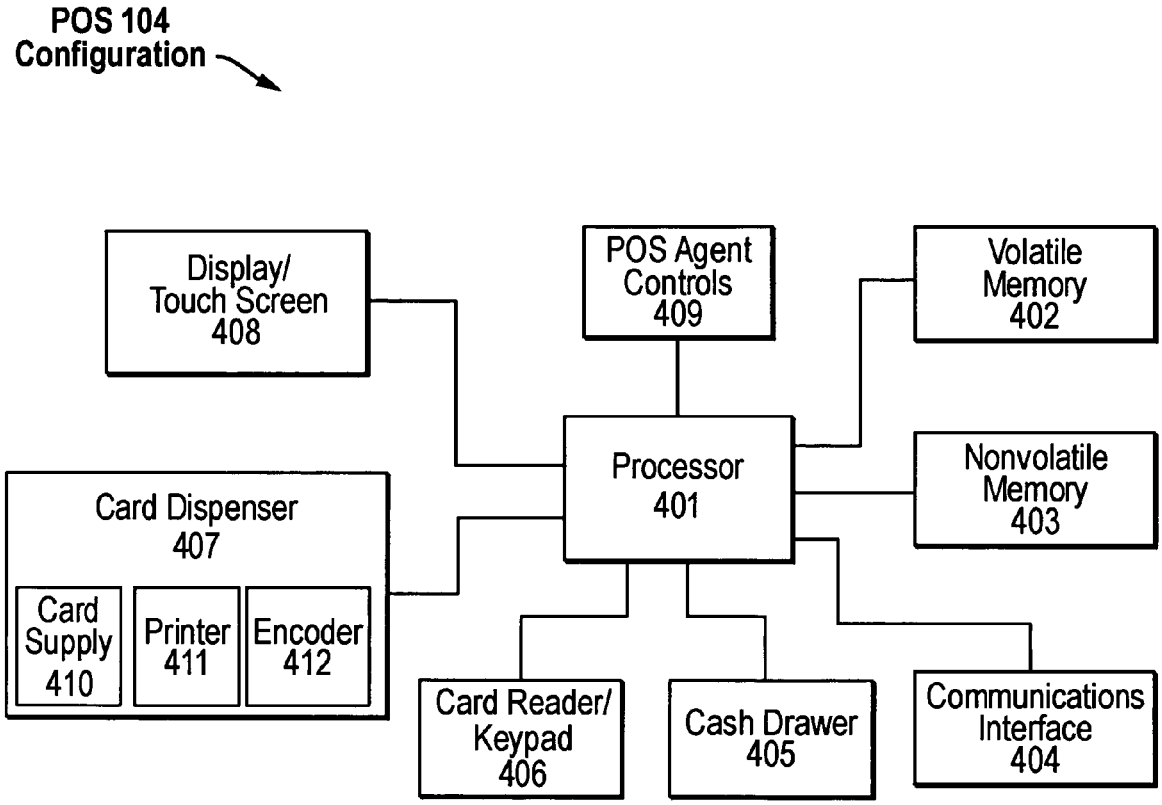
FIG. 4 is a diagrammatic representation of a point-of-sale station that may be used in the system shown in FIG. 1.

FIG. 4 shows one preferred arrangement for a POS station 104 within the scope of the present invention. POS station 104, which may be referred to as a physical bingo card issuing station according to the present invention, preferably includes a processor 401, volatile memory 402, nonvolatile memory 403, and a communications interface 404. The volatile and nonvolatile memory store computer program code that may be executed by processor 401 to cause the processor to perform or direct the various functions provided by POS station 104. Communications interface 404 allows communications between POS station 104 and its respective LAS 102 and/or CGS 101. POS station 104 shown in FIG. 4 also includes a user interface arrangement to facilitate a POS station operator or agent, and/or a player to interface with the gaming system 100 shown in FIG. 1 for various purposes. This interface includes agent controls 409, a display or touch screen display 408, and a card reader/keypad 406. Controls 409 and display 408 allow a station agent to enter various requests and other information in gaming system 100. The nature of these requests or information will depend upon the specific features of the gaming system. For example, controls 409 and display 408 may allow a station agent to enter a request to open a player account in gaming system 100 or a request to withdraw cash from the account where the account maintains cash or credit balances for players in the gaming system. Controls 409 and display 408 may also allow a station agent to enter a request for a physical bingo card according to the present invention. Card reader/keypad 406 comprises a device that can read or otherwise identify information from a player card or some device that may be used as a player card such as a physical bingo card according to the present invention. A keypad associated with card reader/keypad 406 allows a player to enter a PIN that may be associated with the player card or player account, or with a physical bingo card according to the present invention.

POS station 104 further includes a card dispenser 407 and a cash drawer 405. Cash drawer 405 is included at the illustrated POS station 104 to facilitate the acceptance of cash to open a cash/credit account for the player or to facilitate payments of cash to the player where the player account system provided through gaming system 100 tracks cash or credit balances for the players. Card dispenser 407 dispenses a physical bingo card, such as that shown in FIGS. 6A and 6B, that may be used by a player to participate in bingo games according to the present invention. Card dispenser 407 comprises a dispenser containing a supply 410 of pre-printed/encoded physical bingo cards or blank cards or substrates that may be used to produce the physical bingo cards. In the pre-printed/encoded card alternative, dispenser 407 merely dispenses one or more of the pre-printed physical bingo cards in response to a command entered at the POS station 104, and perhaps reads an identifier associated with the dispensed physical bingo card. In the blank card alternative, dispenser 407 may include a printing device 411 to print information regarding one or more bingo structures on the blank card. The information may include a representation of the respective bingo structure and/or an alphanumeric or machine readable identifier that identifies the card and relates the card to a bingo structure definition stored at a suitable component in gaming system 100. Card dispenser 407 may also include an encoding device 412 for encoding information on the blank cards to be dispensed to the players. For example, the physical bingo card may carry a magnetic medium such as a stripe of magnetic recording material, and the encoding device 412 may include a mag stripe writer capable of writing a card identifier, bingo structure identifier, or other information on the card. Alternatively, the blank cards may carry a minute integrated circuit chip or some other data storage arrangement which may carry information about the dispensed card such as a card identifier, bingo structure identifier, or other information. It will be appreciated that in some preferred forms of the invention, POS station 104 will have the capability of dispensing physical bingo cards to players in an automated fashion through a mechanical dispensing structure included with card dispenser 407. Alternatively, and particularly where pre-printed and/or pre-encoded cards are to be dispensed, POS station 104 may include an arrangement in which the physical bingo cards are manually removed from the bingo card supply comprising a roll or fan folded group of connected physical bingo cards.

It will be appreciated that the particular configurations of devices shown in FIGS. 1 through 4 are shown only for purposes of example. A bingo gaming system according to the present invention may omit some or all of the separate LAS's 102 at the various gaming facilities so that the EPS's 103 communicate directly with CGS 101. Also, various regions or different gaming facilities may be divided up into separate systems each having a respective CGS such as CGS 101. In these situations the system could be configured such that a single EPS 103 may be serviced by any of the CGSs. Furthermore, a gaming system embodying the principles of the invention may include multiple CGSs rather that a single CGS 101 as shown in FIG. 1. A given gaming facility may also include more than one LAS 102 where the gaming facility includes more EPSs 103 than a single LAS 102 may service.

In the following description of FIG. 5 and the other block diagrams or process flow charts in this disclosure, it will be appreciated that the references to the physical components are references to the diagrams in FIGS. 1 through 4 that show those components. The components, such as POS stations 104, EPSs 103, LASs 102, and CGS 101 discussed with reference to the flow charts are generally not shown in the flow charts themselves but are shown particularly in FIG. 1.

Figure 5:
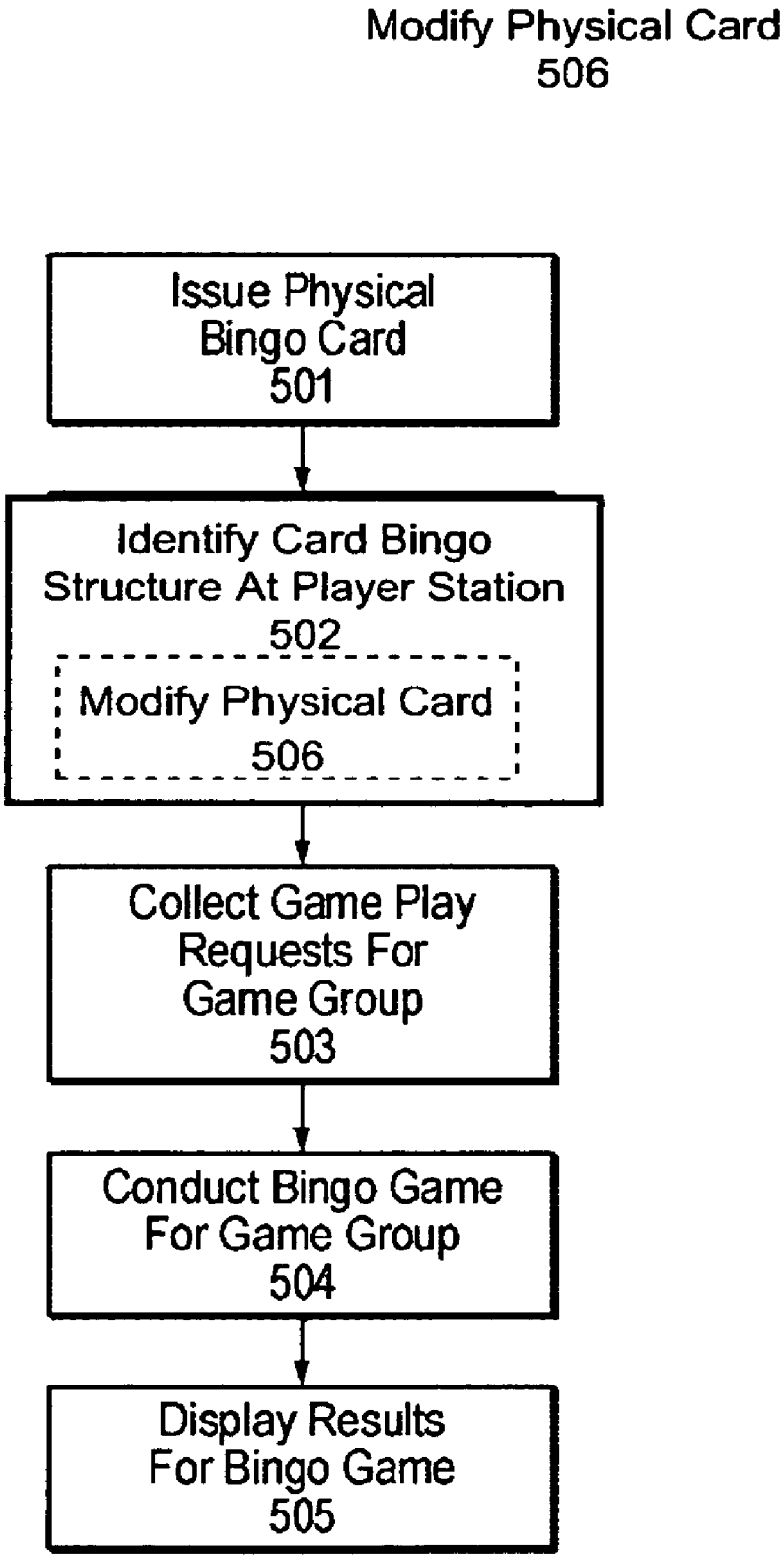
FIG. 5 is a block diagram illustrating the overall process employed by the present invention to enable a player to participate in a networked bingo gaming system using a physical bingo card.

Referring now to FIG. 5, a method embodying the principles of the invention includes issuing a physical bingo card as indicated at block 501. This physical bingo card issued to a player in the gaming system is associated with at least one card bingo structure. This card issuing step is performed by a POS station 104 in a preferred form of the invention under the control of card issuing program code to perform the card issuance, card bingo structure printing on the physical bingo card if such printing is done in the given embodiment, and the encoding or printing of information on the physical bingo card to the extent such encoding or printing is done in the given embodiment. It will be appreciated that physical bingo cards according to the present invention need not be issued at a POS station 104 or other similar station. Rather, it is possible for physical bingo cards according to the invention to be issued from an EPS 103 or other player station, or from an unattended kiosk for example. Preprinted physical bingo cards may even be issued manually with no need for any device in communication with the gaming system network, such as system 100 shown in FIG. 1.

A method according to the invention also includes the step of identifying or reading the card bingo structure(s) through a player station (such as EPS 103 in FIG. 1) as indicated at block 502. This identification step performed through the player station is preferably performed at least in part by a dedicated controller associated with a scanner under the control of scanner program code. Device 308 or device 309 may comprise such a scanner with a dedicated scan controller. Alternatively, device 308 or 309 may simply produce an output signal that is processed by the processor (300 in FIG. 3) associated with the respective EPS 103.

With the card bingo structure identified or read at an EPS 103, a game play request entered from the player station, also preferably under the control of the player station program code in response to a player input, is collected with at least one additional game play request to form a first game group as indicated at block 503. The game play request entered from the EPS 103 is associated with the card bingo structure identified or read at the EPS, and each additional game play request in this collected game group is associated with a respective additional bingo structure. The collection of the game play request together with the additional game play requests may be performed by CGS 101 or some other suitable component in gaming system 100, such as an LAS 102, under the control of game server program code executed at that system component.

As shown at block 504 in FIG. 5, the method also includes conducting a bingo game between the card bingo structure and each additional bingo structure to identify a bingo game result for the card bingo structure and preferably the additional bingo structures. The bingo game may be conducted by a suitable processing element using definitions for the bingo structures included in the game group, a ball draw definition, and definitions for the various winning patterns available in the bingo game. This processing element will operate under the control of the game server program code in preferred forms of the invention.

A method according to the invention further includes displaying the bingo game result for the card bingo structure at the EPS 103 from which the game play request associated with the card bingo structure was entered as indicated at block 505. This display or communication of the bingo game result is performed at the EPS 103 preferably under the control of the player station program code executed at the player station.

It will be noted that the additional game play requests grouped with the game play request associated with the card bingo structure to form the game group need not be associated with a physical bingo card or a respective card bingo structure. The gaming system may require that the game group is made up only of game play requests associated with a physical bingo card. Alternatively, game play requests that are not associated with a physical bingo card may be grouped together with those that are associated with such a card. In any case, the same system component, such as CGS 101 in FIG. 1, collects the game play requests, segregates them as necessary to enforce the rules of the various gaming facilities serviced by the component, and conducts the bingo games to identify the bingo results. It will be appreciated that any game play requests not associated with a physical bingo card may be entered using an EPS 103 process similar to that disclosed at FIG. 6 of incorporated application Ser. No. 10/456,721, rather than the process described below with reference to FIG. 7 for game play requests associated with a physical bingo card. Any segregation of game play requests between those associated with physical bingo cards and those that are not may be performed as described in U.S. patent application Ser. No. 10/752,293, filed Jan. 6, 2004, and entitled "Method, System, and Program Product for Grouping Game Players by Class." The entire content of this prior application is also incorporated herein by this reference.

The step of issuing the physical bingo card as shown in block 501 may be accomplished in many different ways within the scope of the invention. In one form of the invention, physical bingo cards are pre-printed and/or pre-encoded and are simply dispensed "as is" from a suitable dispenser such as 407 in FIG. 4, either an automated dispenser which dispenses a card in response to some control or a manual dispenser which requires the card to be manually removed from the supply of bingo cards. However, some preferred forms of the invention include actually printing and/or encoding information on a substrate to produce a physical bingo card at the time the card is dispensed. The information that may be printed or encoded on the substrate or blank card will be described further with reference to FIGS. 6A and 6B below.

Identifying the card bingo structure at EPS 103 may include several different steps within the scope of the present invention. In one alternative arrangement, the physical bingo card includes one or more printed or encoded card bingo structures and the step of identifying the card bingo structure(s) includes scanning the physical bingo card to produce a scan output, and then applying pattern recognition to the scan output. Applying the pattern recognition process or algorithm results in a scanned card bingo structure that may be associated directly with the game play request entered through the EPS 103. Alternatively, a verification process may be applied to ensure the scanned card bingo structure correctly reflects the actual bingo structure printed or encoded on the physical bingo card. Such a verification process may involve matching the scanned card bingo structure to a card bingo structure stored in a list of issued card bingo structures. Verification may also involve comparing a physical bingo card identifier read or identified from the physical bingo card with a physical bingo card identifier identified by reading an identifier associated with a card bingo structure matched to the scanned card bingo structure. That is, verification of the scanned card bingo structure may include first matching the scanned card bingo structure to a card bingo structure in a stored list, reading an identifier associated with the card bingo structure in the stored list, and comparing that identifier with an identifier read or determined from the physical bingo card. If these two card bingo structure identifiers do not match, then it is apparent that there has been some error. The error may be in the scanning or pattern recognition applied to identify the card bingo structure. Such an error may require rescanning the card bingo structure or inputting the card bingo structure at the EPS 103 in some alternative or fall back fashion, such as by manual entry for example. Any verification process to verify the card bingo structure identified by the scanner is preferably conducted with a scan verification controller or processor under the control of verification program code. Such a scan verification controller may be implemented with the processor 300 at the EPS or with processor 200 or 201 at the LAS 102 or CGS 101, or with any other suitable processing device in the system.

A gaming system according to the present invention may also support a player's ability to add to or delete card bingo structures associated with the issued physical bingo card. This bingo card modification step is shown at block 506 in FIG. 5. The step may be accomplished through a POS station 104 or through an EPS 103 in preferred forms of the invention. The modification process may be initiated with a player/POS agent entering a change request at the EPS/POS station. Although the change request may simply associate a further or replacement card bingo structure with the physical bingo card automatically in response to the change request, the change request preferably initiates a bingo structure selection dialog that allows a player to select a replacement or further card bingo structure from a set of available bingo structures, or even build their own card bingo structure with bingo designations of their own choice at each respective spot in the bingo structure.

The step of collecting the game play request associated with the physical bingo card and card bingo structure together with the additional game play requests as indicated at block 503 in FIG. 5 is preferably performed by CGS 101 as will be discussed further below with reference to FIG. 9. However, game group collection may also be performed at a respective LAS 102 as will be described with reference to FIG. 8. Regardless of how the game group collection is performed or where it is performed, it will be appreciated that where the physical bingo card identified at block 502 is associated with more than one card bingo structure, the game play request entered through the respective EPS 103 must include an indicator as to which card bingo structure is to be in the request, or which bingo structures are to be included in the request. For example, where the bingo games are conducted in fixed bingo sessions, each respective card bingo structure may be associated with a respective bingo game in a sequence of bingo games making up a bingo session.

The conduct of the bingo game for the game group as shown at block 504 in FIG. 5 is likewise preferably performed at a central processing device such as CGS 101 or and LAS 102. Wherever the bingo game is conducted in the gaming system, the results identified in the course of conducting the bingo game are communicated back to the respective EPS 103 so that the EPS may display the results of the bingo game to the player. This communication to facilitate displaying results may or may not include communicating to the EPS 103 the ball draw used for the game. Also, the results of the bingo game may be displayed in a standard bingo format with a representation of a daubed bingo card on the player's display or in some alternative display such as a reel-type display for example. In yet other alternatives, results may be displayed both as in traditional bingo and in some alternative presentation or display, simultaneously or one after the other.

Figure 6A:
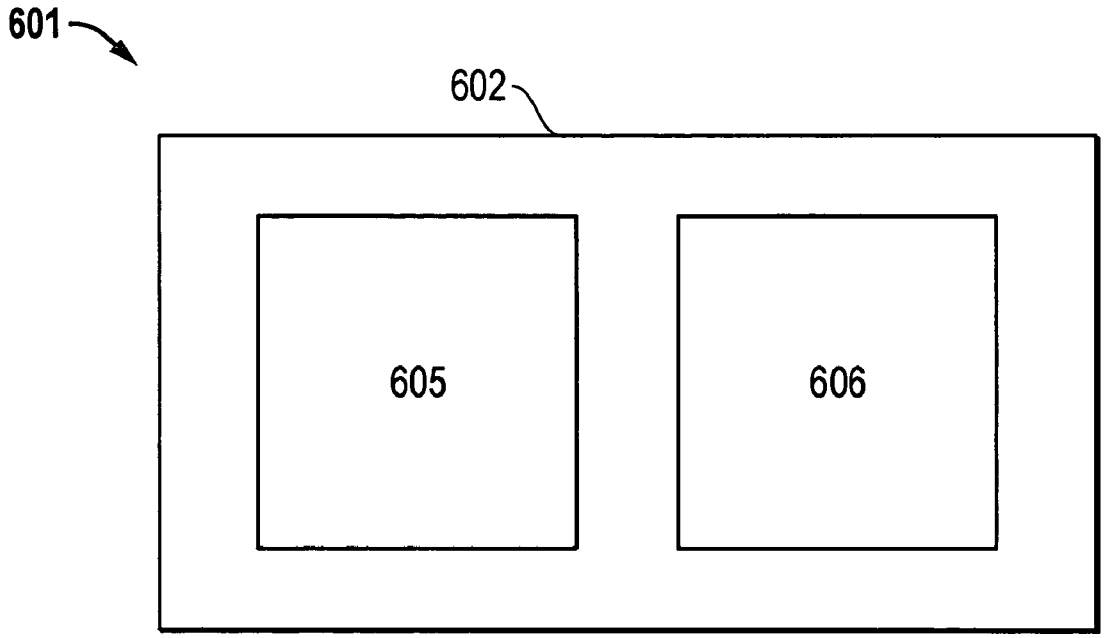
FIG. 6A is a representation of a first side of a physical bingo card that may be employed in the present invention.
Figure 6B:
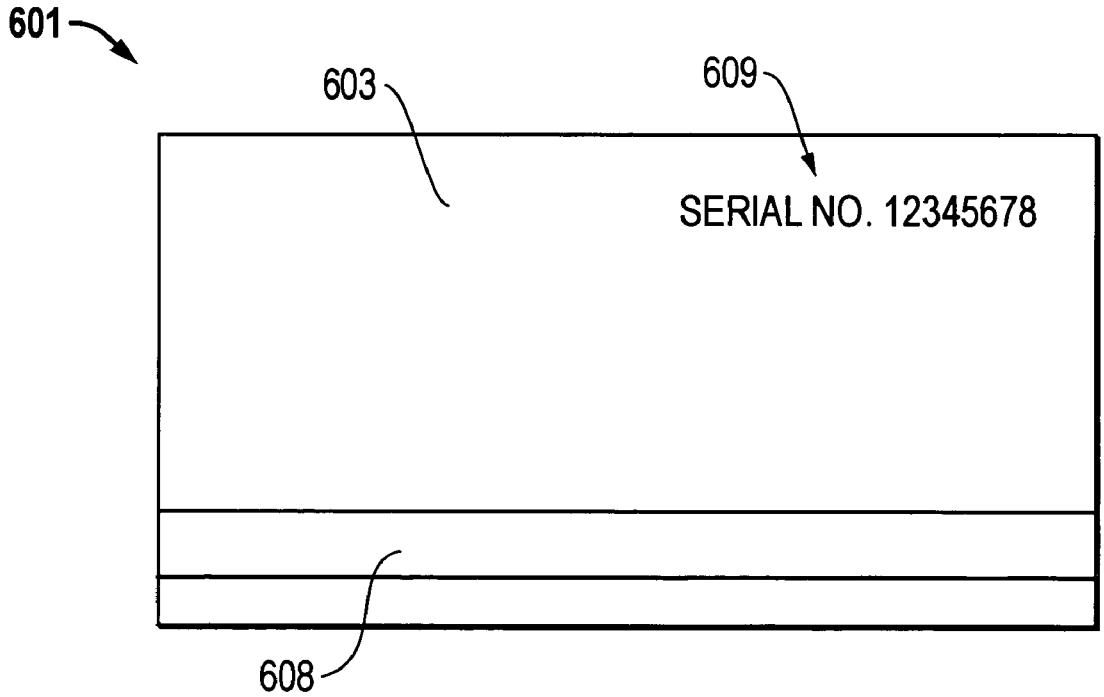
FIG. 6B is a representation of a second side of the physical bingo card shown in FIG. 6A.

FIGS. 6A and 6B illustrate one preferred form of physical bingo card 601 according to the present invention. This particular physical bingo card 601 includes a first face 602 shown in FIG. 6A and an opposite face 603 shown in FIG. 6B. The card substrate may be formed from any suitable material such as paper or plastic and preferably has a shape similar to a credit card, driver's license or other identification card, or a ticket such as those commonly issued in automobile parking systems. First face 602 includes representations 605 and 606 of two different card bingo structures. These structures, which are shown diagrammatically in the figures may comprise any suitable structure for use in a bingo game such as the traditional 5 by 5 structure, a 3 by 3 structure, or any other structure of locations through which various location patterns may be identified to distinguish game winners. Although two card bingo structures 605 and 606 are shown, any number may be included on the card 601 from none to many. In some forms of the invention, the player must use a different card bingo structure for each game play request. In this form of the invention, card 601 may contain enough bingo structures for a complete bingo session with a large number of individual bingo games. Multiple peel off layers (not shown) may be included on card 601 to facilitate carrying more bingo structures on the card.

Side 603 of the physical bingo card 601 shown in FIG. 6B includes a stripe of magnetic material 608 which can be encoded with a card identifier or with data necessary to actually define the bingo structures 605 and 606 associated with the card. A serial number 609 is also printed on side 603 of card 601. It will be appreciated that forms of the invention may include different types of data carriers other than magnetic material 608, such as an integrated circuit chip for example. Also, the data encoded on material 608 may instead be encoded in a bar code printed on the physical bingo card. Furthermore, spare space on side 603 may be printed with additional card bingo structures.

Preferred forms of the invention maintain a physical bingo card table at a respective suitable memory device at one or more components of the game system. This physical bingo card table may be used to maintain the association between a respective bingo structure and a respective card. One preferred structure for the physical bingo card table includes a number of entries, one entry for each physical bingo card issued in the gaming system. Each entry includes a card identifier unique to the particular physical card and entry, and an identifier or a definition for each card bingo structure associated with the physical card. Each entry may have additional information about the player or the respective physical bingo card. In any case such a table allows the gaming system to identify the card bingo structure(s) associated with a given physical bingo card by doing a look up in the table with the card identifier. Conversely, a physical card with which a card bingo structure is associated may be identified by doing a look up using the card bingo structure identifier or definition.

Figure 7:
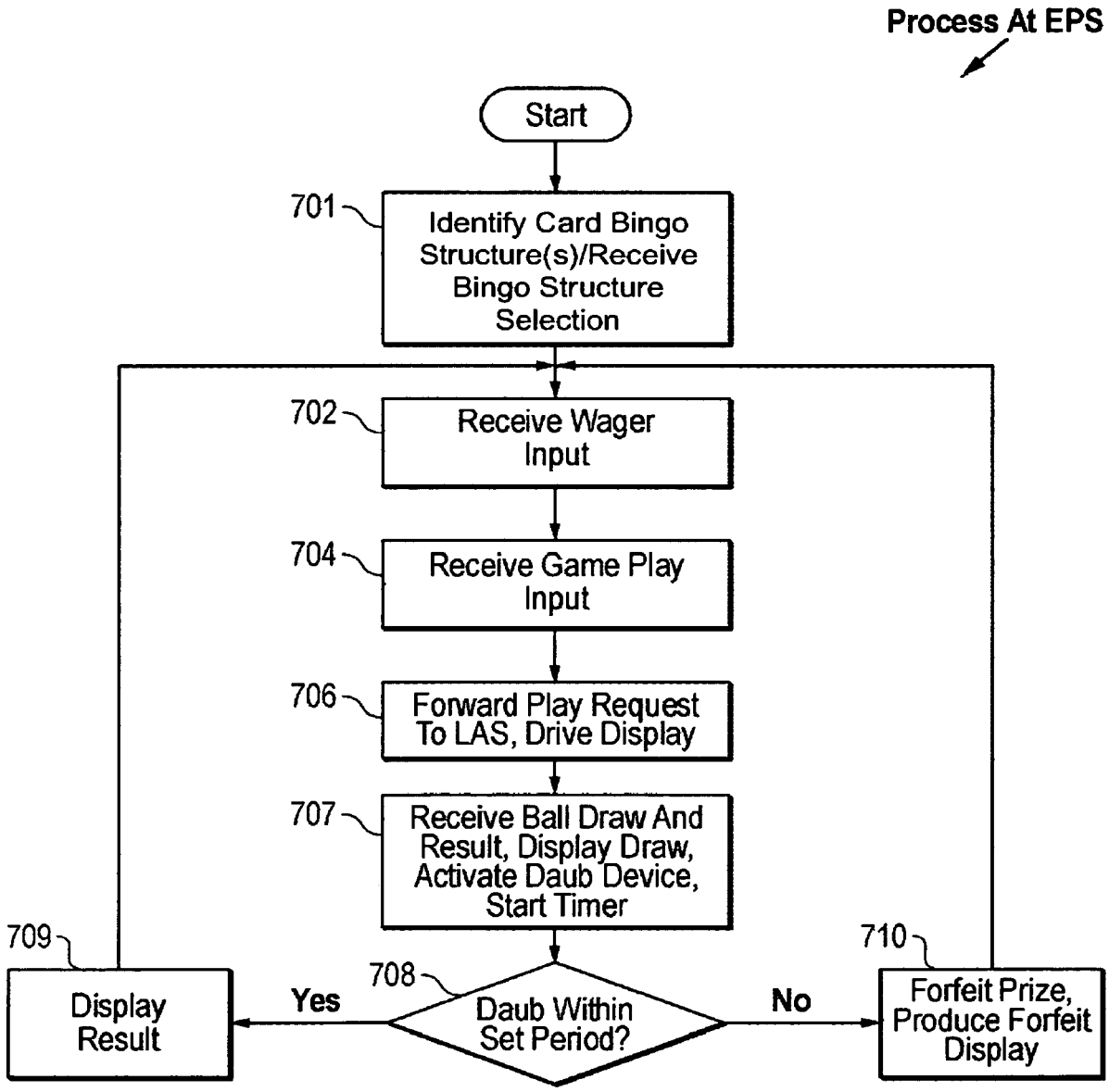
FIG. 7 is a flowchart providing a high level description of a process executed at the electronic player stations according to a preferred form of the present invention.

FIG. 7 shows a process that may be performed at an EPS 103 according to the invention. After EPS 103 is initialized and activated for use by a player, the process at the EPS includes identifying the card bingo structure(s) as shown at block 701. This corresponds to the step 501 in the overall process shown in FIG. 5. In some forms of the invention, the process at block 701 may include receiving a card bingo structure selection entered through the player station where the physical bingo card is associated with more than one card bingo structure. The process at block 701 in FIG. 7 may also include a process in which the player may enter a change request to select a different card bingo structure to be associated with their physical bingo card.

It will be appreciated that the card bingo structure identification step shown at process block 701 in FIG. 7 may require communications between the respective EPS 103 and its respective LAS 102 or the CGS 101. In particular, unless the EPS 103 stores a data table of physical bingo card identifiers for physical bingo cards that have been issued in the gaming system, the BPS will have to query such a table stored at some other system component such as an LAS 102 or the CGS 101 in order to verify the identified card bingo structure.

The EPS process shown in FIG. 7 allows the player to enter a wager or card price for playing a respective card bingo structure in a game offered through an EPS 103. The wager input is shown at block 702 in FIG. 7. This input may be entered through a player control 304 at the respective EPS 103 or a suitable interface associated with screen/touch screen 305 shown in FIG. 3. In preferred forms of the invention, the player may choose from a number of different wager levels or card price levels for each card bingo structure the player places in play and these card price levels may be defined in terms of currency, credits, or in some other fashion.

Once the card bingo structure to be placed in play is identified at EPS 103, and the price of the card bingo structure or wager is defined, the card bingo structure may be entered in a bingo game administered by the system 100 in which the respective EPS 103 is included. As indicated at process block 704 in FIG. 7, EPS 103 may wait for a separate game play input or game play request entered by the player at the EPS, and only then proceed to forward the game play request to the other components of system 100. In other preferred forms of the invention, a separate input may not be required in order for the player to enter into a bingo game. For example, simply defining the wager at block 702 may automatically enter the identified or designated card bingo structure in a bingo game without any separate game play request, or, where the wager is predefined, the step of identifying the particular card bingo structure may enter the player in a bingo game.

Once the player has, in one fashion or another, made an input at EPS 103 to enter their card bingo structure(s) in a bingo game administered through the gaming system (100 in FIG. 1), the EPS forwards a game play request to the respective LAS 102 as indicated at process block 706 in FIG. 7, and preferably drives a display showing some type of entertaining graphics pending the return of the respective result for each player's card bingo structure placed in play. For example, EPS 103 may be configured to display results associated with the underlying bingo game in terms of reel stop positions for a reel-type gaming machine (slot machine). For this type of result display, the step of driving the display at process block 706 may include showing a number of reels spinning to imitate the spinning reels one would see immediately after activating a traditional reel-type gaming machine. Alternatively, results from the bingo game may be displayed in some other entertaining fashion such as a horse or dog race for example, and the step of driving the display shown at process block 706 in FIG. 7 may include an initial portion of the race. In yet other forms of the invention, results may be displayed as in a traditional bingo game and the step of driving the display shown at process block 706 in FIG. 7 may include simply displaying each bingo structure that has been placed in play. Even where the results of the bingo game may be shown with entertaining graphics unrelated to the bingo game, a portion of the display at EPS 103 is preferably devoted to a representation of the card bingo structure in play and ball draw for the bingo game in which the card is entered.

The nature of the communication forwarding the play request to LAS 102 will depend upon a number of factors. For example, the communication may include an actual bingo structure definition for each card bingo structure placed in play. Alternatively, where bingo structure definition files are available at the various system components as described above, the communication may include a bingo structure identifier for each card bingo structure placed in play and this identifier may be used to locate the actual card definition. In still other forms of the invention, the player's card bingo structure or structures placed in play from EPS 103 may be known to the LAS or CGS based on an identification of the player at the EPS or in some other way. In this case, the game play request sent to LAS 102 at block 706 in FIG. 7 may not include even an identifier for the bingo structure(s) in play, but merely some signal for the LAS to place the bingo structure(s) in play for the requesting player.

Regardless of how EPS 103 drives the display at process block 706 in FIG. 7, the EPS preferably receives a ball draw for each game in which the player has been entered and, for each card bingo structure placed in play, a game play result which has been identified at the LAS 102 or CGS 101 as will be described in detail below. The receipt of the ball draw(s) and result is shown at process block 707 in FIG. 7. Although the single block 707 is shown for receiving the ball draw for the respective bingo game, it will be appreciated that certain forms of the invention may deliver only a portion of an entire ball draw and then require some player input from EPS 103 in order to receive the remainder of the ball draw. The result received at EPS 103 represents the result of the respective player's card bingo structure in the bingo game in which the player's card bingo structure has been entered. As in any bingo game, the result is associated with some pattern and/or sequence of spots on the player's bingo structure that have been matched by designations in the ball draw. However, it will be appreciated that the result communicated to EPS 103 at process block 707 is preferably some result code that represents the actual bingo result. The ball draw and result may be sent to EPS 103 separately or in a single communication. In either case, the preferred form of the invention displays the ball draw on the display associated with the EPS 103 prior to the time the respective game result is displayed.

In some preferred forms of the bingo gaming system, the bingo player must claim their bingo prize associated with a winning result. In systems in which the player must claim their prize, the EPS process may include activating a prize claiming or daub input at EPS 103 in the event a game play returns a winning result. This prize claiming or daub input activation is included at process block 707 in FIG. 7 along with the activation of a timer which sets a time period for the player to actuate the prize claiming or daub input and claim the prize. In a preferred form of the process at EPS 103, the EPS also produces a display indicating to the player that they must take a particular action to claim their prize, and indicating or counting down the time remaining to claim the prize. This timer or countdown display may be in addition to or in lieu of the display initiated at process block 706. A countdown timer display according to the invention may be superimposed on the display initiated at process block 706.

If the player claims their prize by taking the appropriate action within the set period of time as indicated by decision block 708 in FIG. 7, EPS 103 displays the result of the game for the player as indicated at process block 709, and gaming system awards the prize to the player. In the example described above in which the results may be displayed by reel-type or slot machine graphics, the display at EPS 103 may show reels stopped in particular positions that together correspond to the result achieved by the player in the bingo game. In the example where the results are shown by a horse or dog race, EPS 103 may show a particular horse or dog in a win, place, or show position corresponding to the result the player has achieved in the bingo game.

In the event the player at EPS 103 does not take the required action to claim the prize within the set period of time, the prize associated with the player's result in the bingo game may be forfeited as indicated at process block 710. In the case of a forfeited prize, EPS 103 may also produce a suitable display to indicate to the player that the prize associated with the play in the bingo game has been forfeited. Any forfeited prizes may be collected and applied to a progressive game offered through system 100 or may be collected for use as a charitable contribution. The forfeiture process may include subtracting a prize value from the player's account. This prize value may have been previously added to the player's account by system 100 automatically in response to the winning result.

Whether a prize has been forfeited as shown at process block 710 or has been claimed and the result displayed as shown at process block 709, the process at EPS 103 may return to wager input and game play input steps 702 and 704 as shown in FIG. 7. Alternatively, a number of different options may be provided to the player at EPS 103 to allow the player to choose a different card bingo structure to enter in another bingo game administered through system 100.

In some instances, the result from the bingo game may not be associated with any prize. In these instances, the process at EPS 103 may not activate a daub or prize claiming input device, and not wait for an input before displaying the result. Rather, the process at EPS 103 may simply include displaying the non-winning result immediately after receiving the result from LAS 102 without further intervention on the part of the player.

It will be noted from FIG. 7 that participation in a bingo game offered through an EPS 103 can be thought of as a three-step process aside from any login step that may be required at the EPS. The first step includes the card bingo structure identification process and the buy-in or wager amount selection process as indicated at process blocks 701 and 702 in FIG. 7. In the second step, the player puts the card in play as indicated at process block 704 in FIG. 7. In the third step required to participate in a game, the player daubs the card once the bingo numbers have been drawn. This last participation step is indicated by the decision block 708 in FIG. 7. The course taken from decision block 708 turns upon whether the prize claiming or daub input has been entered by the player.

In some forms of the invention, the player's failure to enter a prize claiming or daub input may not result in the forfeiture of the prize, but rather cause the underlying bingo game to proceed with the ball draw (or additional numbers in the already defined ball draw sequence). In these forms of the invention, a player's failure to claim the game ending prize causes the underlying bingo game to continue with additional bingo numbers until another game ending winner is produced. This new game ending winner may then be given the opportunity to claim the game ending prize. If the player fails to enter the prize claiming or daub input at this point, the prize may be forfeited or the game may proceed again until another new game ending winner is determined.

In yet other forms of the invention, the EPS 103 may force the player to take a daubing action in order to proceed on to another game. Also, the daubing step may be defined broadly so as to ensure that a player takes the daubing step to claim their prize. For example, where a player card must be inserted into an EPS 103 in order for a player to participate in a bingo game offered through system 100, the act of removing the player card may be defined as an act of daubing a card if the EPS 103 is waiting for a daub input from the player.

Figure 8:
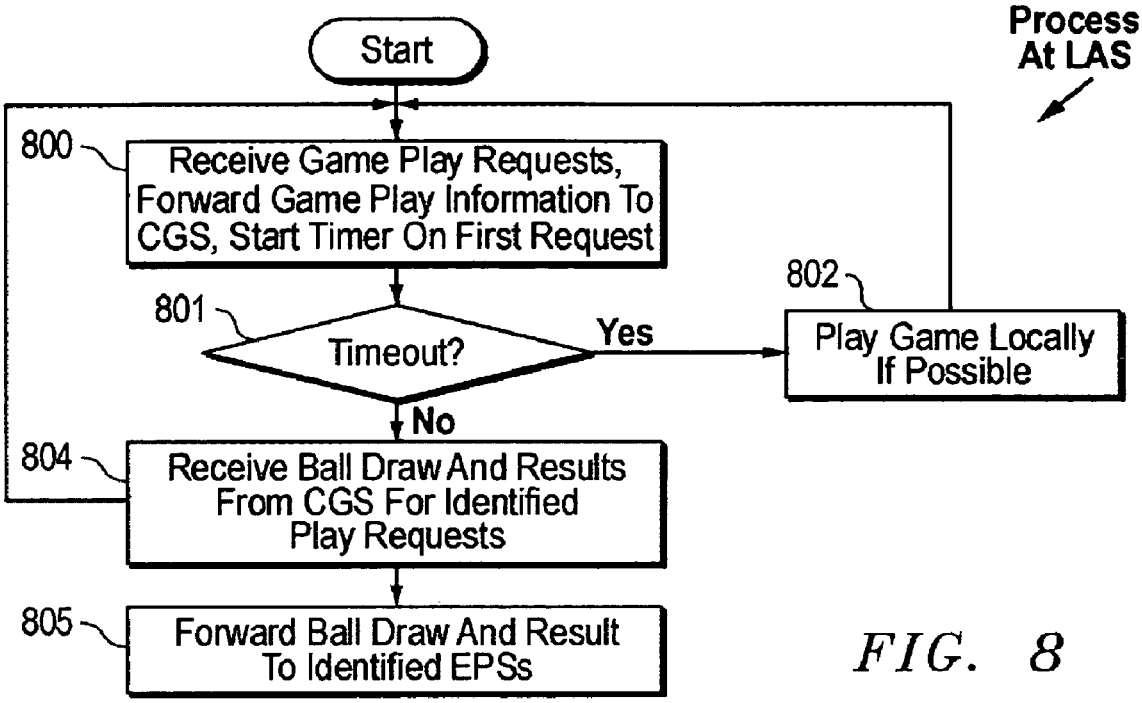
FIG. 8 is a flowchart providing a high level description of a process executed at the local area servers according to a preferred form of the present invention.
Figure 9:
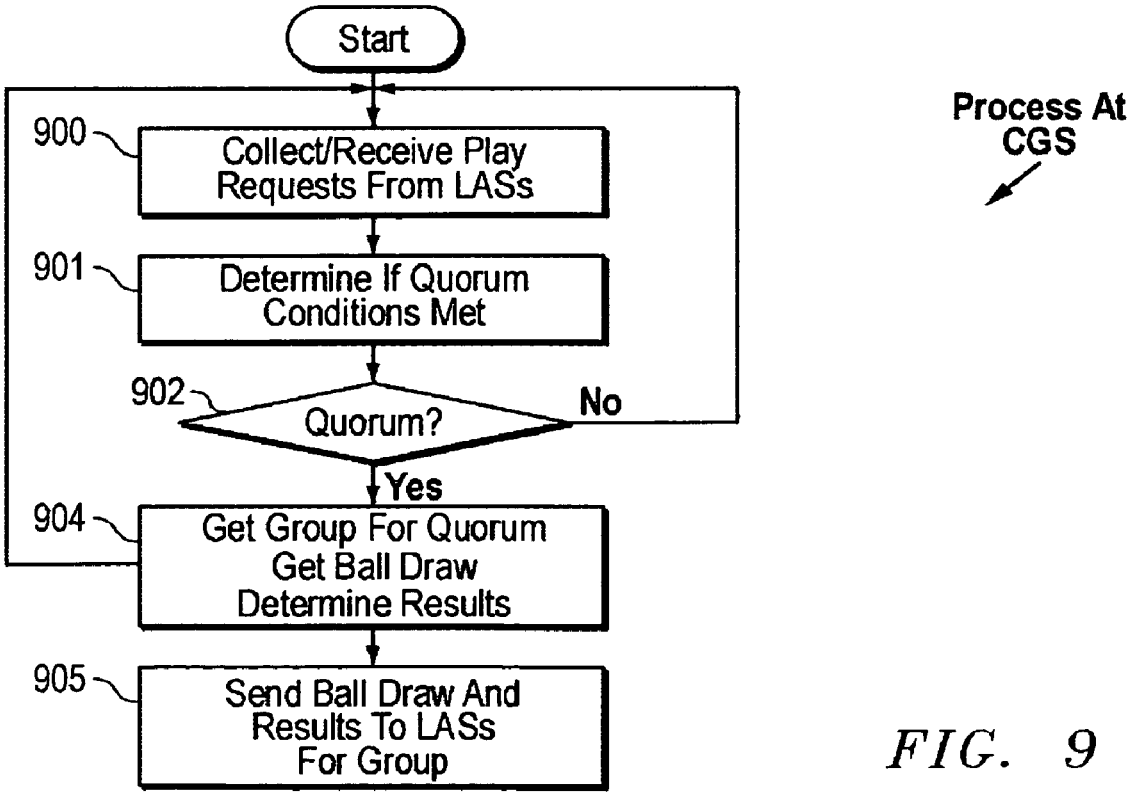
FIG. 9 is a flowchart providing a high level description of a process executed at the central game server according to a preferred form of the present invention.

FIGS. 8 and 9 may be used to describe one preferred arrangement for cooperation between the LASs 102 and the CGS 101 in system 100 shown in FIG. 1, and to describe the processes performed at the LASs 102 and CGS 101 in that arrangement.

Referring now to FIG. 8, one preferred process at each LAS 102 within the scope of the present invention includes at process block 800 receiving a game play request from one of the EPSs 103 serviced by respective LAS and immediately forwarding the game play request to CGS 101 along with information associated with the request such as a bingo structure definition or physical bingo card identifier from which the card definition may be determined. As shown at process block 800, the LAS process may also include starting a timer on the receipt of the first game play request from a local EPS 103 for a given game. If a timer set at process block 800 times out before CGS 101 returns a ball draw and results for the game play requests which have been collected and forwarded to the CGS as indicated at decision block 801, LAS 102 may attempt to play the game locally if possible as indicated at process block 802. A timeout may occur if the communications link has been broken with CGS 101, or if the communications link has been degraded in some fashion. In this case, it is necessary for LAS 102 to attempt to play games with only local players. Of course, if quorums cannot be produced locally with sufficient speed, LAS 102 may simply notify the EPSs 103 that new games are not presently available, or if the situation is transient, return even money results to the requesting players as discussed further below.

In situations where no timer is used at LAS 102 or a timeout has not occurred at decision block 801, the LAS receives a ball draw for the game play requests it has forwarded to CGS 101 along with the results of the game for those play requests/players. The actual communications between LAS 102 and CGS 101 may require that the ball draw is sent in one communication and the results are sent as a separate communication or communications, otherwise both the ball draw information and results for the game may be sent as a single communication. At process block 804, LAS 102 receives the ball draw and results for the collected number of game play requests that were forwarded to CGS 101. The process at LAS 102 then proceeds to forward the received ball draw to the EPSs 103 from which the collected game play requests originated, as shown at process block 805. LAS 102 also forwards the results for the various game play requests, that is, the game results, to the respective EPSs 103. It will be noted that once a ball draw and results have been received for one group of game play requests that have been forwarded to CGS 101, the process returns back to process block 800 and continues to receive and forward game play requests for another bingo game as indicated by the line returning from block 804 to a point in the process immediately below the starting point.

FIG. 9 shows a process at CGS 101 that may be used in connection with the LAS process shown in FIG. 8. The process for CGS 101 includes collecting or receiving play requests from the various LASs 102 as shown at process block 900 in FIG. 9. CGS 101 also determines if predetermined quorum conditions have been met as shown at process block 901. A preferred process for this quorum determining step will be described below with reference to FIG. 10. If it is determined that conditions for a quorum have not been met at decision block 902, the process returns back to process block 900 to collect or receive further play requests from LASs 102. However, if conditions for a quorum have been met as indicated at decision block 902, CGS 101 collects or segregates the group of game play requests making up the quorum for a bingo game, obtains or produces a ball draw for the game, and determines the results associated with the game by comparing the ball draw with the bingo structure(s) associated with the game play requests which make up the quorum. These functions are shown at process block 904 in FIG. 9. In addition to the other steps set out at process block 904, the process returns back to process block 900 to begin collecting game play requests from the LASs for another bingo game. As shown at process block 905 in FIG. 9, CGS 101 also communicates the ball draw and results for a given game to the LASs 102 implicated for the particular quorum that was determined at process block 901.

Figure 10:
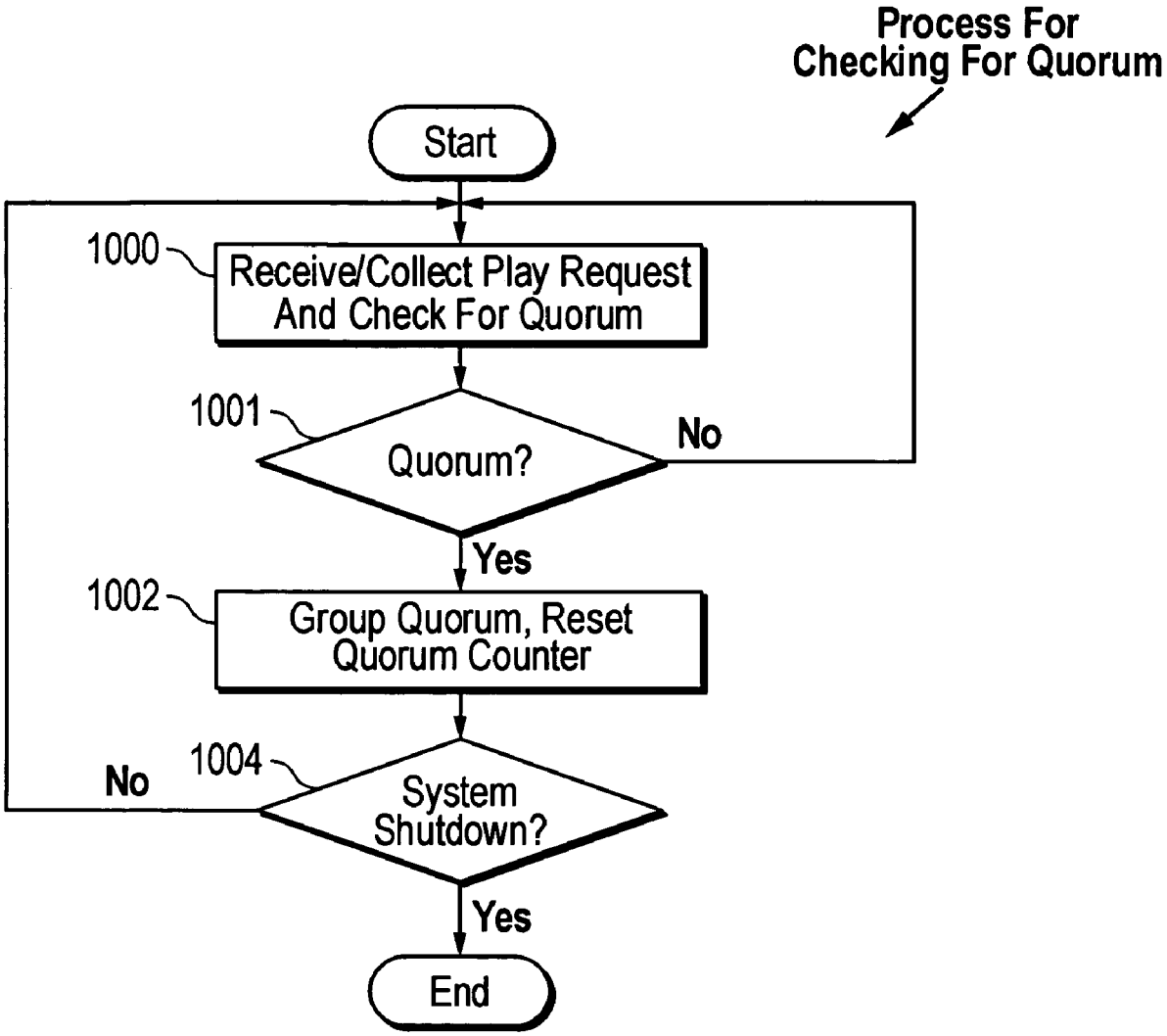
FIG. 10 is a flowchart showing a process for defining a game group for a bingo game according to one preferred form of the present invention.

FIG. 10 shows one preferred process for checking for a quorum of game play requests according to the present invention. In this process, checking for a quorum is not conducted according to any time schedule. Rather, the quorum checking process includes receiving or collecting a game play request and then immediately checking for a quorum as indicated at process block 1000. In one preferred arrangement for implementing the process shown in FIG. 10, each received game play request (or data representing the game play request) is stored in a first in/first out queue. Checking for a quorum in this implementation includes checking to see if all or a desired number of queue locations have been allocated, that is, store valid data for a received game play request. Instead of checking to see if the desired number of queue locations have been allocated, the quorum checking process may maintain a counter that provides a value indicating the number of received game play requests that are available for grouping for a bingo game according to the present invention. In this implementation, checking for a quorum includes comparing the number of game play requests received by the counter to see if that number is greater than or equal to some desired minimum number for a bingo game.

Regardless of how the system checks for a quorum of collected game play requests, if a quorum is not available as indicated at decision block 1001, the process returns to wait for the next game play request received. However, if it is determined that a quorum is available at decision block 1001, the process proceeds on to process block 1002 at which the quorum is formed, that is, a group of game play requests are identified for a particular bingo game according to the invention. The process at block 1002 may include reading the data from the queue locations for the game play requests in the game group or quorum and deallocating those queue locations to make them available for additional game play request data. Where a counter is used to track the number of received game play requests, the process at block 1002 may include clearing or resetting the counter to start counting game play requests for the next quorum/bingo game. After process block 1002, the process returns to wait for additional game play requests or ends if the system is being shut down as indicated at decision block 1004.

In operation of the present bingo gaming system, there may be situations in which a quorum suitable for playing a bingo game is not obtained in a reasonable time. As discussed above with reference to block 802 of FIG. 8, the system may be configured to return a game play request where a local quorum cannot be produced in a some period of time. Any process for checking for a quorum used in the present system may include a return play request process. Rather than causing the EPSs 103 to ultimately provide some indication to the player that the play request could not be honored, the LAS 102 or CGS 101 as the case may be, may instead send the EPSs 103 from which the game play requests originated a command or signal which causes the EPSs 103 to produce a display showing an even money result. That is, the EPSs 103 may display a result in which the payout is equal to the bet or wager. In this way, the player may not even know that his or her game play request could not be honored and thus they do not feel the frustration that could arise in that situation. Other implementations may return an even money result and cause the EPS 103 to display a message indicating that no game was played to obtain that result. A system embodying the principles of the present invention may display an even money result to a player any time the game play request cannot be honored for whatever reason or just in certain circumstances such as when a quorum cannot be produced in a certain maximum time or when there is some problem with the game play request. The decision to force an even money result at an EPS 103 in lieu of an actual result in a bingo game is preferably made by a system component that identifies the result in the bingo game so as to avoid any conflict with an actual result in a game. However, the present invention may force an even money result display in lieu of an actual result at a component that may not identify the bingo game results. For example, an EPS 103 may be programmed to display an even money result after a certain period of time has elapsed at the EPS after the play request was first communicated.

Many of the process steps described in FIGS. 7-10 are preferably performed by processing devices, such as those described in FIGS. 2 through 4, under the control of operational program code. For example, first collection program code can be used to collect a first group of game play requests at either an LAS 102 or the CGS 101 as described in relation to process blocks 800, 900, and 1000. As discussed previously, the game play requests are collected from a number of EPSs 103. Quorum checking program code can be used to implement process blocks 901 and 1000, which determine if the first group of game play requests collected by the first collection program code meets the predefined condition for a quorum. If the conditions for a quorum are met, then game program code conducts a bingo-type game with the first group of game play requests as described in relation to process blocks 802, and 904. While the game program code is conducting the game with the first group of play requests, second collection program code collects a second group of game play requests from the EPSs 103. In a preferred embodiment, the game program code can begin conducting a second bingo-type game with the second group of game play requests before the first bingo-type game is completed.

In one form, the first quorum checking code includes comparison program code for comparing the number of game play requests collected in each respective game group to a minimum number of game play requests, as discussed in FIG. 10. Preferably, the comparison code implements process block 1000, first using counter program code to count the number of game play requests collected in each respective group of game play requests. In various forms, the quorum checking program code also includes allocation program code for checking if a queue location has been allocated, as discussed in relation to process block 1002 and receipt check program code to check for a quorum after each game play request is received, as discussed in relation to process block 1000.

As discussed above, the present invention is not limited to a quorum grouping gaming system as described with reference to FIGS. 7-10. In particular, the present invention may be implemented in a session bingo gaming system in which bingo games are played in sequence throughout a bingo session. In this session bingo arrangement, the process shown in FIG. 8 would be modified to eliminate the blocks 800, 801, and 802 as shown. Instead, the respective LAS 102 would simply receive its local game play requests, forward game play information to CGS 101, and then wait to receive the ball draw and results back from the CGS. The CGS process for the session bingo alternative would also be modified from the illustrated CGS process shown in FIG. 9. In particular, the steps shown at blocks 901 and 902 may be eliminated. CGS 101 would simply collect game play requests from the LASs 102 for the period of time in which card bingo structures may be placed in play for the given game and then proceed generally with step 904 in FIG. 9 upon completion of that period of time. However, the game group for which results are determined at block 904 would not be for a quorum, but for a particular bingo game in a bingo game session.

Figure 11:
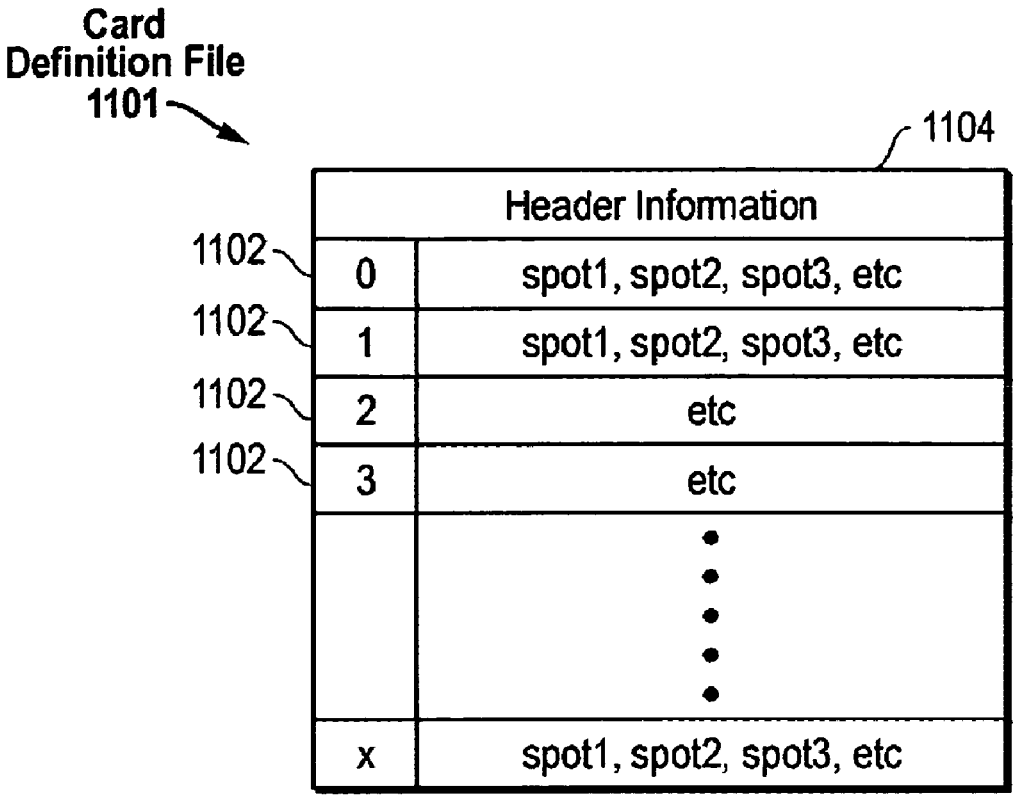
FIG. 11 is a diagrammatic representation of a bingo card definition file that may be used in a bingo gaming system according to the present invention.
Figure 12:
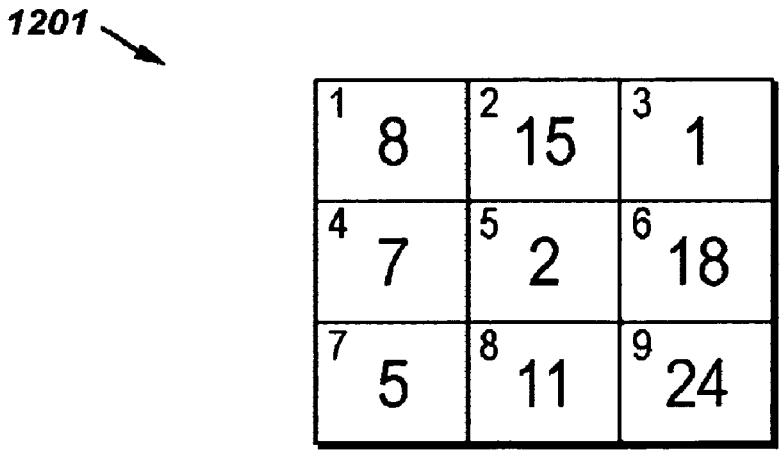
FIG. 12 is a diagrammatic representation of a bingo card face that may be employed in bingo games played in the present invention.

FIG. 11 shows an example data structure for defining bingo structures for use in the gaming system shown in FIG. 1. The data structure represents a bingo structure definition file 1101 that includes a number of records 1102, labeled record 0 through record X in the figure. The file may contain a very large number of bingo structure definitions, for example, three hundred thousand or more records 1102. Bingo structure definition file 1101 will generally also include header information 1104 that may include identifying information for the file and other data related to the bingo structure definition file. The first designation in each record (the designation in the leftmost column in FIG. 11) represents a bingo structure identifier or index that identifies the bingo structure defined by the remainder of the record. The remainder of the record includes a list of designations representing the designations at the various spots in the bingo structure. Using the example 3 by 3 bingo structure 1201 shown in FIG. 12 for the first bingo structure definition, record 1102 in file 1101, the record would read 0, 8, 15, 1, 7, 2, 18, 5, 11, 24. In this structure, the 0 represents the bingo structure identifier or index, the designation "8" represents the designation in spot 1 of card 1201, the designation "15" represents the designation in spot 2 of card 1201, the designation "1" represents the designation in spot 3 in card 1201, and so forth for the remainder of the nine spots included in the bingo structure. It will be noted from FIG. 12 that the spot identifiers are shown as numeric elements in the upper left corner of each spot in the 3 by 3 grid and the larger print number in the middle of each spot represents the bingo designation associated with that spot.

It will be appreciated that the invention may use bingo structure definition data structures different from those shown for purposes of example in FIG. 11. For example, the identifier may be located at any location within the data structure and the spots may not be in the order indicated in FIG. 11.

The process described above at FIG. 7 relating to the process at an EPS 103 indicates that more than one bingo structure may be placed in a play by a given player. The EPS 103 may be adapted in this alternative to simultaneously display multiple results in one or more bingo games, one result associated with each game play request, that is, each bingo structure placed in play. One arrangement in which multiple bingo results may be displayed simultaneously is described in reference to FIG. 13 of U.S. patent application Ser. No. 10/456,721, previously incorporated herein by reference, and will not be repeated here. The arrangement described in this earlier application utilizes a reel-type or slot machine type display to show the multiple results. Of course results for multiple simultaneous game play may be disclosed to the player at a player station using multiple conventional bingo displays which show the respective bingo structure and the pattern produced by daubing the card against the ball draw.

It will be noted that in the forms of the invention in which players may place multiple bingo structures in play simultaneously, or the same bingo structure in play multiple times, each bingo structure or instance of the same structure may represent a single game play request. The resulting multiple game play requests made by a player putting multiple bingo structures, or multiple instances of the same bingo structure in play simultaneously may be grouped in a single bingo game according to the invention or may be grouped in multiple different bingo games, depending upon the particular process for grouping game play requests to produce a quorum according to the invention.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method including the steps of:

(a) issuing a physical bingo card, the physical bingo card being associated with a card bingo structure;

(b) scanning the physical bingo card at a player station to produce a scan output and applying pattern recognition to the scan output in identifying the card bingo structure through the player station;

(c) collecting a game play request entered from the player station with at least one additional game play request to form a first game group, the game play request being associated with the card bingo structure and each additional game play request in the first game group being associated with a respective additional bingo structure;

(d) conducting a bingo game between the card bingo structure and each additional bingo structure to identify a bingo game result for the card bingo structure; and (e) displaying the bingo game result for the card bingo structure at the player station.

2. The method of claim 1 wherein each respective additional game play request and each respective additional bingo structure are associated with a respective additional physical bingo card which has been issued.

3. The method of claim 1 wherein scanning the physical bingo card is performed with an optical scanner.

4. The method of claim 3 wherein the scanning the physical bingo card is performed with a currency scanner.

5. The method of claim 1 further including the step of looking up a card bingo structure identifier based on the identification of the card bingo structure.

6. The method of claim 1 wherein the bingo game conducted for the first game group comprises a bingo game in a session bingo sequence.

7. The method of claim 1 wherein the at least one additional game play request and respective additional bingo structure are not associated with a respective physical bingo card.

8. The method of claim 1 wherein issuing the physical bingo card includes issuing the physical bingo card to a player so that the player receives the physical bingo card before the step of collecting the game play request.

9. The method of claim 1, wherein (a) includes issuing the physical bingo card to a player, wherein the player receives the physical bingo card before the collecting of the game play request in (c), and wherein the collecting of the game play request includes the player station receiving data from the physical bingo card, the data being entered at the player station by the player.

10. An apparatus including:

(a) a physical bingo card issuing station for issuing a physical bingo card, the physical bingo card being associated with a card bingo structure;

(b) a player station having a scanner associated therewith, the scanner for scanning the physical bingo card to identify the card bingo structure, and the player station for producing a game play request associated with the card bingo structure in response to a player input at the player station and for communicating a bingo game result to a player at the player station; and (c) a game server in communication with the player station, the game server for collecting the game play request produced by the player station with at least one additional game play request associated with a respective bingo structure to form a first game group, and for conducting a bingo game between the card bingo structure and each additional bingo structure to identify the bingo game result for the card bingo structure.

11. The apparatus of claim 10 further including a respective additional player station for each respective additional game play request, each respective additional player station including a respective scanner for scanning a respective additional physical bingo card to identify a respective card bingo structure associated with the respective additional physical bingo card, for producing the respective additional game play request in response to a player input at the respective additional player station, and for communicating a bingo game result for the respective bingo structure to a player at the respective additional player station, wherein each respective additional game play request is associated with the respective card bingo structure identified through the respective player station.

12. The apparatus of claim 10 wherein the scanner comprises a pattern recognition device.

13. The apparatus of claim 12 wherein the pattern recognition device comprises an optical scanner.

14. The apparatus of claim 12 wherein the pattern recognition device comprises a currency acceptor.

15. The apparatus of claim 10 further including a scan verification controller for comparing the card bingo structure identified by the scanner with a stored card bingo structure stored in memory accessible by the scan verification controller.

16. The apparatus of claim 10 further including an account server for maintaining a player account associated with the physical bingo card.

17. The apparatus of claim 10 wherein the physical bingo card includes a card identifier associated therewith and wherein the scanner is also for reading the card identifier.

18. The apparatus of claim 10, including respective additional player stations for producing respective additional game play requests, wherein at least one of the additional player stations is operable for producing one of the respective additional game play requests having a respective additional bingo structure that is not associated with a respective physical bingo card.

19. The apparatus of claim 10, wherein the physical bingo card issuing station is operable for issuing the physical bingo card to the player, and wherein the player station is operable for scanning the physical bingo card responsive to the physical bingo card being received by the player station from the player.

20. The apparatus of claim 10, wherein the physical bingo card issuing station is operable for issuing the physical bingo card to the player, and wherein the player station is operable for receiving data from the physical bingo card entered at the player station by the player.

21. A program product stored on a computer readable medium, the program product including:

(a) scanner program code for controlling the operation of a player station scanner to identify a card bingo structure associated with a physical bingo card;

(b) player station program code for producing a game play request associated with the card bingo structure in response to a player input at the player station, and for controlling communication of a bingo game result to a player at the player station; and (c) game server program code for controlling collection of the game play request produced by the player station program code with at least one additional game play request associated with a respective additional bingo structure to form a first game group, the game server program code also for conducting a bingo game between the card bingo structure and each additional bingo structure to identify the bingo game result for the card bingo structure.

22. The program product of claim 21 wherein the scanner program code is also for controlling the operation of the player station scanner to identify a currency value associated with currency received in the scanner.

23. The program product of claim 21 further including card bingo structure verification program code for verifying the card bingo structure identified by the player station scanner.

24. The program product of claim 23 wherein the card bingo structure verification program code verifies the card bingo structure at least in part by comparing the card bingo structure identified from the physical bingo card to a stored set of card bingo structures.

25. The program product of claim 23 wherein the card bingo structure verification program code verifies the card bingo structure at least in part by comparing an identifier obtained from the physical bingo card with a stored set of physical bingo card identifiers.

26. The program product of claim 21 wherein the at least one additional game play request and respective additional bingo structure of (c) is not associated with a respective physical bingo card.

27. The program product of claim 21 wherein the player receives the physical bingo card before the collecting of the game play request.

* * * * *